US006893207B2

(12) United States Patent
Kao

(10) Patent No.: US 6,893,207 B2
(45) Date of Patent: May 17, 2005

(54) IMPELLER FOR GASSY WELL FLUID

(75) Inventor: Alan Lin Kao, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/656,411

(22) Filed: Sep. 5, 2003

(65) Prior Publication Data

US 2004/0047728 A1 Mar. 11, 2004

Related U.S. Application Data

(63) Continuation-in-part of application No. 10/091,238, filed on Mar. 5, 2002, now Pat. No. 6,676,366.

(51) Int. Cl.[7] ..... F04D 29/24
(52) U.S. Cl. ..... 415/58.2; 416/181
(58) Field of Search ..... 415/58.2, 106, 415/199.2; 416/181, 183

(56) References Cited

U.S. PATENT DOCUMENTS

| | | | | |
|---|---|---|---|---|
| 2,576,700 | A | | 11/1951 | Schneider |
| 4,778,341 | A | | 10/1988 | Corradini et al. |
| 5,156,522 | A | * | 10/1992 | Tessier ..... 415/58.2 |
| 5,224,821 | A | | 7/1993 | Ozawa |
| 5,628,616 | A | | 5/1997 | Lee |
| 5,885,058 | A | | 3/1999 | Vilagines et al. |
| 6,241,470 | B1 | | 6/2001 | Oakley et al. |
| 2003/0170112 | A1 | | 9/2003 | Kao |

FOREIGN PATENT DOCUMENTS

| | | |
|---|---|---|
| FR | 1.025.250 A | 4/1953 |
| SU | 653.428 A | 3/1979 |

* cited by examiner

*Primary Examiner*—Edward K. Look
*Assistant Examiner*—Kimya N. McCoy
(74) *Attorney, Agent, or Firm*—Bracewell & Patterson, L.L.P.

(57) ABSTRACT

A centrifugal pump pumps well fluid with a high gaseous content by utilizing an impeller design for use in gaseous liquids. The impeller has high discharge angles and large balance holes. The impeller has short and long vanes alternating with each other. The shorter vanes have a leading surface that is concave in shape. In one design, the longer vanes have a radially outward portion of a leading surface that is concave in shape. The radially outward portion of the longer vanes of this design has substantially the same radius of curvature as the shorter vanes. The radially inward portion of the leading edge of the longer vanes can be concave or convex in shape. The outer ends of the longer vanes can extend from the circumference of the impeller or be located inward from the outer ends of the short vanes

21 Claims, 5 Drawing Sheets

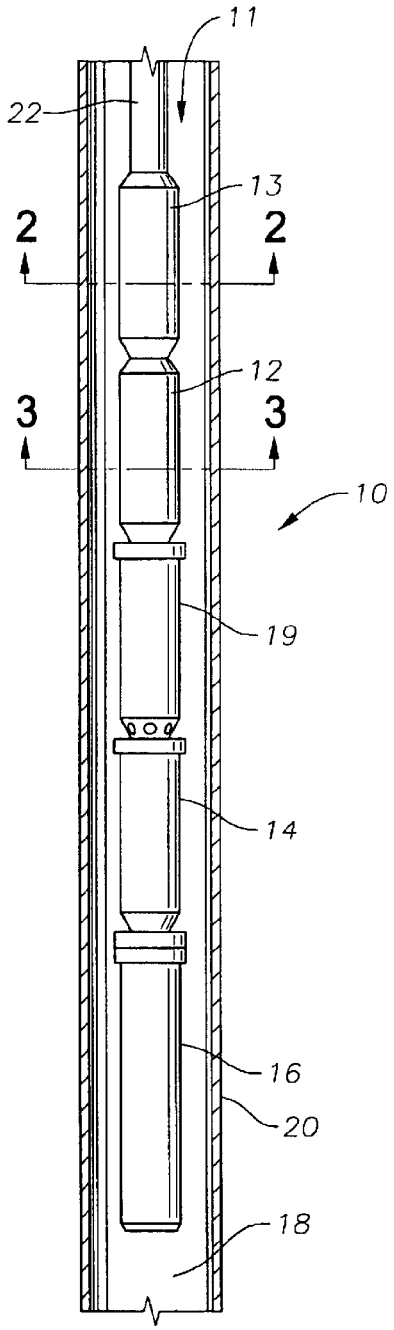
Fig. 1
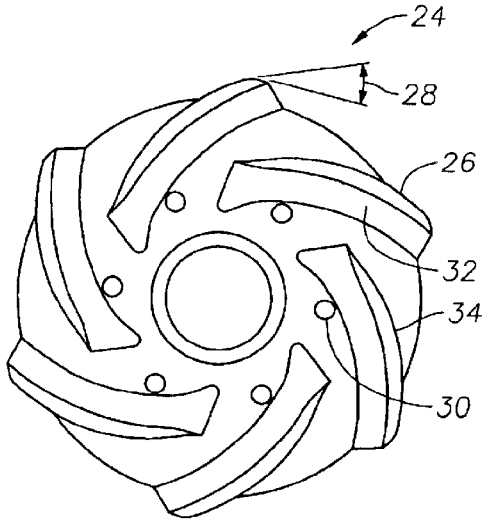
Fig. 2
(Prior Art)
Fig. 3
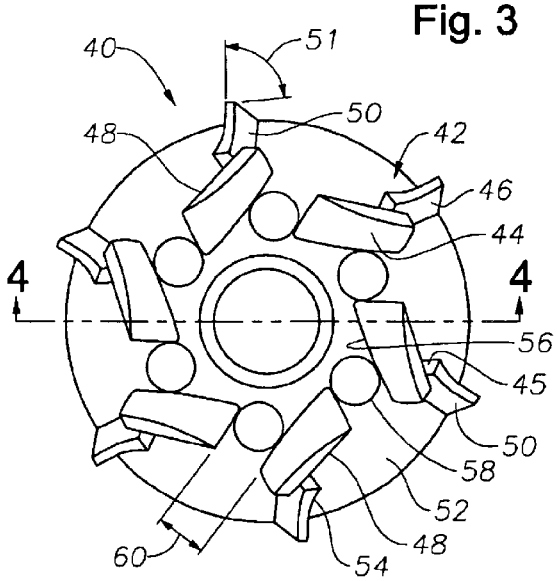

IMPELLER FOR GASSY WELL FLUID

RELATED APPLICATIONS

This continuation-in-part patent application claims the benefit of co-pending, non-provisional patent application U.S. Ser. No. 10/091,238, filed on Mar. 5, 2002 now U.S. Pat. No. 6,676,366, which is hereby incorporated by reference in its entirety.

BACKGROUND OF THE INVENTION

1. Field of the Invention

This invention relates in general to electric submersible pumps. More specifically, this invention relates to submersible pumps that have an impeller configuration designed for fluids with a high gas content entrained within the fluids.

2. Background of the Invention

Centrifugal pumps have been used for pumping well fluids for many years. Centrifugal pumps are designed to handle fluids that are essentially all liquid. Free gas frequently gets entrained within well fluids that are required to be pumped. The free gas within the well fluids can cause trouble in centrifugal pumps. As long as the gas remains entrained within the fluid solution, then the pump behaves normally as if pumping a fluid that has a low density. However, the gas frequently separates from the liquids.

The performance of a centrifugal pump is considerably affected by the gas due to the separation of the liquid and gas phases within the fluid stream. Such problems include a reduction in the pump head, capacity, and efficiency of the pump as a result of the increased gas content within the well fluid. The pump starts producing lower than normal head as the gas-to-liquid ratio increases beyond a certain critical value, which is typically about 10–15% by volume. When the gas content gets too high, the gas blocks all fluid flow within the pump, which causes the pump to become "gas locked." Separation of the liquid and gas in the pump stage causes slipping between the liquid and gas phases, which causes the pump to experience lower than normal head. Submersible pumps are generally selected by assuming that there is no slippage between the two phases or by correcting stage performance based upon actual field test data and past experience.

Many of the problems associated with two phase flow in centrifugal pumps would be eliminated if the wells could be produced with a submergence pressure above the bubble point pressure to keep any entrained gas in the solution at the pump. However, this is typically not possible. To help alleviate the problem, gases are usually separated from the other fluids prior to the pump intake to achieve maximum system efficiency, typically by installing a gas separator upstream of the pump. Problems still exist with using a separator upstream of a pump since it is necessary to determine the effect of the gas on the fluid volume in order to select the proper pump and separator. Many times, gas separators are not capable of removing enough gas to overcome the inherent limitations in centrifugal pumps.

A typical centrifugal pump impeller designed for gas containing liquids consists of a set of one-piece rotating vanes, situated between two disk type shrouds with a balance hole that extends into each of the flow passage channels formed by the shrouds and two vanes adjacent to each other. In liquid lifting practice, an average value of 25 degrees is considered normal for all vane discharge angles. The size of the balance holes have traditionally been approximately ⅛" (0.125") through 3⁄16" (0.1875") in diameter for most pump designs. Deviations from the typical pump configurations have been attempted in an effort to minimize the detrimental effects of gaseous fluids on centrifugal pumps. However, even using these design changes in the impellers of the centrifugal pumps is not enough. There are still problems with pump efficiency, capacity, and head.

One such attempt to modify a conventional centrifugal pump impeller for pumping fluids containing a high percentage of free gas can be found in U.S. Pat. No. 5,628,616 issued to Lee. The Lee Patent teaches the use of balance and recirculation holes for pressure equalization and recirculation of the fluid around the impeller.

A need exists for an ESP and method of pumping high gas containing fluids without causing a pump to become gas-locked and unable to pump the fluid. Ideally, such a system should be capable of being adapted to the specific applications and also be able to be used on existing equipment with minimal modification.

SUMMARY OF THE INVENTION

Centrifugal pumps impart energy to a fluid being pumped by accelerating the fluid through an impeller. This invention provides a novel method and apparatus for pumping well fluid with a high gaseous content by utilizing a centrifugal pump with an improved impeller design that is optimized for use in gaseous liquids. The improved pump uses an impeller having new vane designs, which can be combined with high discharge angles and large balance holes. The balance holes can be between about 45 to about 100 percent of the distance from a surface of one vane to a radially inward leading edge of an adjacent vane.

This invention introduces an unconventional split-vane impeller design with increased vane exit angle and oversized balance holes. The improvements provide homogenization to the two-phase flow due to the split-vane design. Pump performance is optimized by increased vane exit angle, which is typically in the range of about 50 degrees to about 90 degrees. The oversized balance holes provide additional gas and liquid mixing. The split-vane impeller comprises two portions, an inner radial member and an outer radial member, with each portion having a different radius of curvature.

This invention also introduces an unconventional impeller design with short and long vanes, an increased exit angle, and oversized balance holes. The longer vanes alternate with the short vanes. The shorter vanes have a leading surface that is concave in shape. The longer vanes have a radially outward portion of a leading surface of the longer vanes that is concave in shape. The radially outward portion of the longer vanes has substantially the same radius of curvature as the shorter vanes. The radially inward portion of the leading edge of the longer vanes can be concave or convex in shape.

BRIEF DESCRIPTION OF THE DRAWINGS

So that the manner in which the features, advantages and objects of the invention, as well as others which will become apparent, may be understood in more detail, more particular description of the invention briefly summarized above may be had by reference to the embodiment thereof which is illustrated in the appended drawings, which form a part of this specification. It is to be noted, however, that the drawings illustrate only a preferred embodiment of the invention and is therefore not to be considered limiting of the invention's scope as it may admit to other equally effective embodiments.

FIG. 1 is a side elevational view of a centrifugal pump disposed in a viscous fluid within a well, constructed in accordance with this invention.

FIG. 2 is a sectional view of a conventional design of an impeller taken along the line 2—2 of FIG. 1.

FIG. 3 is a sectional view of an impeller of the centrifugal pump of FIG. 1, taken along the line 3—3 of FIG. 1.

DETAILED DESCRIPTION OF THE PREFERRED EMBODIMENT

Figure 4:
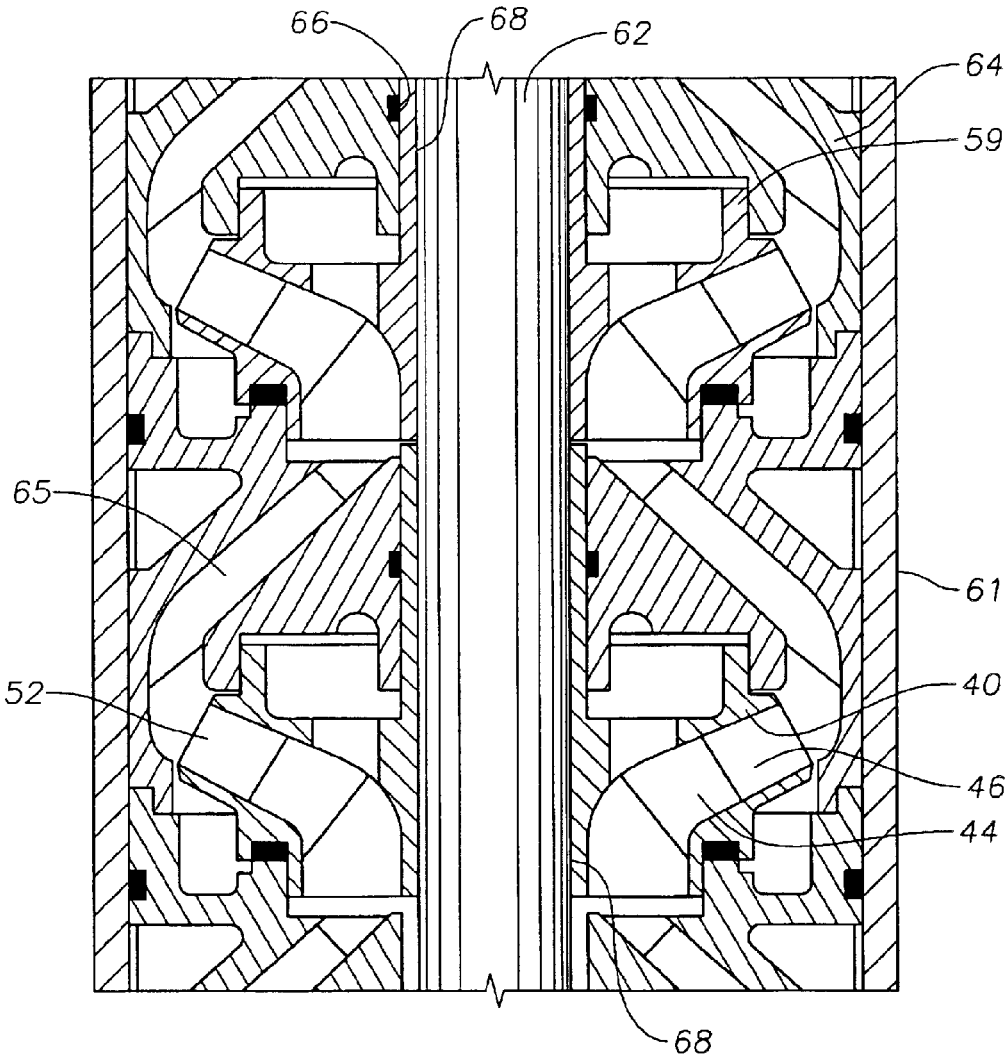
FIG. 4 is a sectional view of a diffuser and an impeller taken along the line 4—4 of FIG. 3.

Referring to the drawings, FIG. 1 generally depicts a well 10 with a submersible pump assembly 11 installed within. The pump assembly 11 comprises a centrifugal charge pump 12 connected to a centrifugal pump 13 that has a seal section 14 attached to it and an electric motor 16 submerged in a well fluid 18. Centrifugal pump 13 has standard design impellers. The shaft of motor 16 connects to the seal section shaft (not shown), which in turn is connected to a gas separator 19 that is connected to the charge pump 12. The pump assembly 11 and well fluid 18 are located within a casing 20, which is part of the well 10. Pump 13 connects to tubing 22 that is needed to convey the well fluid 18 to a storage tank (not shown) or pipeline.

The submersible pump assembly 11 depicted in FIG. 1 shows one embodiment of the invention. Other variations include the omission of the gas separator 19 or the use of one centrifugal pump 13 that comprises at least one impeller designed in accordance with the new invention. Other suitable variations will be known to those skilled in the art and are within the scope of the present invention.

FIG. 2 illustrates a conventionally designed impeller 24 taken along the line of 2—2 of FIG. 1. Impeller 24 comprises a plurality of vanes 26, each of which discharges fluid at an exit angle 28. Vanes 26 of conventional design have a unibody, one-piece design. Exit angle 28 typically ranges between 15 degrees to 35 degrees. Impeller 24 can have balance holes 30. Balance holes 30 are located between vanes 26 and are typically positioned closer to a back, or concave, side 32 than the pressure, or convex, side 34 of each vane 26.

FIG. 3 illustrates an impeller 40 that has been designed in accordance with the present invention taken along the line of 3—3 of FIG. 1, which is within charge pump 12. Impeller 40 comprises a plurality of vanes 42. Vanes 42 comprise two pieces, an inner radial member 44 and an outer radial member 46. The inner radial member 44 and outer radial member 46 have a different radius of curvature, with the inner radial member 44 having a larger radius of curvature than the outer radial member 46. The length of the inner radial member 44 is greater than the length of outer radial member 46. The inner radial member 44 has a larger radius of curvature than the outer radial member 46. Preferably inner radial member 44 curves about the same as an inner portion of vanes 26 of the prior art impeller 24 of FIG. 2. Outer radial member 46 curves more sharply.

The vane configuration shown in FIG. 3 is referred to herein as a split-vane configuration. In the split-vane configuration shown in FIG. 3, a leading side 48 of the inner radial member 44 is concave and thereby defines the radius of curvature for inner radial member 44. Trailing side 56 is located opposite inner radial member 44 from leading side 48. A leading side 54 of outer radial member 46 is concave and defines the radius of curvature for outer radial member 46. Trailing side 50 is on the opposite side of outer radial member 46 from leading side 54. In the embodiment shown in FIG. 3, leading side 48 of inner radial member 44 is offset from trailing side 50 of the outer radial member 46, without leading side 48 of inner radial member 44 contacting the trailing side 50 of the outer radial member 46.

A gap 45 exists between the outer end of inner member 44 and the inner end of outer radial member 46. The split-vanes 42 have an exit angle 51 that typically ranges between about 50 degrees up to about 90 degrees. The exit angle 51 is measured from a line tangent to the circular periphery of impeller 40 to a line extending straight from the outer radial member 46.

Split-vanes 42 also comprise a plurality of flow passages 52 defined between adjacent vanes 42 leading sides 48, 54 of the radial members 44, 46 and trailing sides 56, 50 of radial members 44, 46. A balance hole 58 is located in each flow passage 52. Each balance hole 58 extends upward from each passage 52 through the upper side or shroud 59 (FIG. 4) of impeller 40. Balance holes 58 have a diameter in a range of about 45% to about 100% of a distance 60 measured from leading side 48 of the inner radial member 44 to trailing side 56 of the next inner radial member 44. In the embodiment shown in FIG. 3, balance holes 58 are substantially tangential on opposite sides to the inner radial members 44 of adjacent vanes 42 defining the respective flow passage 52 in which each balance hole 58 is located.

With reference to FIG. 4, centrifugal pump 12 has a housing 61 (not shown in FIG. 2) that protects many of the pump 12 components. Pump 12 contains a shaft 62 that extends longitudinally through the pump 12. Diffusers 64 (only one partially shown) have an inner portion with a bore 66 through which shaft 62 extends. Each diffuser 64 contains a plurality of passages 65 that extend through the diffuser 64. An impeller 40 is placed within each diffuser 64. Impeller 40 also includes a bore 68 that extends the length of impeller 40 for rotation relative to diffuser 64 and is engaged with shaft 62. Thrust washers (not shown) are placed between the upper and lower portions between the impeller 40 and diffuser 64.

Impellers 40 rotate with shaft 62, which increases the velocity of the fluid 18 being pumped as the fluid 18 is discharged radially outward through passages 52. The fluid 18 flows inward through diffuser passages 65 and returns to the intake of the next stage impeller 40, which increases the fluid 18 pressure. Increasing the number of stages by adding more impellers 40 and diffusers 64 can increase the pressure of the fluid 18.

The split-vane geometry minimizes the phase separation by reducing the pressure differential between the pressure side, or leading sides 48, 54, and the suction side, or trailing sides 56, 50 of the vane 42, which helps maintaining homogeneity of the two-phase fluid. Gap 45 between inner radial member 44 and outer radial member 46 allows the fluid to flow between the members 44, 46, allowing for greater homogenization between the two phases. The oversized balance hole 58 opens up the passageway connecting the front, or upper, side and the back, or lower, side of the impeller 40 that makes the space in the balance chamber on the back side of the impeller available for additional gas and liquid mixing. The large vane exit angle 51 aligns the secondary flow lines formed inside the impeller in the direction of the main flow. The alignment is due to the changes in flow direction, the curved shape of the vane 42, and the influence of the pressure gradients between vanes. Inner and outer radial members 44, 46 have different radii of curvature. The different radii aids in the mixing of the materials in the two phases. As a result, the influence of the flow in the boundary layer upon the main flow is a decrease in the flowrate in the boundary layer and possibly a large energy loss, but only under certain circumstances. As an example, as the discharge pressure increases, the gaseous fraction is reduced with the compression of the two-phase fluid.

Pump 12 of the embodiment shown in FIGS. 1–4 can be used as a charge pump ahead of conventional centrifugal pump 13, preferably in a lower tandem configuration. As an alternative, one single centrifugal pump can be utilized that has at least one of the impellers designed in accordance with the present invention and at least one conventional impeller.

In a gaseous application, the pump efficiency is mostly controlled by the phase separation due to the gas velocity being significantly lower than the liquid velocity and the vacant zone inside the impeller. This effect becomes relatively smaller if the gas is well mixed in the liquid. The interphase drag force in the homogenous flow is so large that the pump performance will not dramatically decrease until phase separation occurs. The new impeller designs have significant advantages. The present inventions reduce the likelihood of centrifugal pumps becoming gas locked due to a high gas content in the well fluid. The new designs also improve the performance of the centrifugal pumps by increasing the pump head, capacity, and efficiency.

Figure 5:
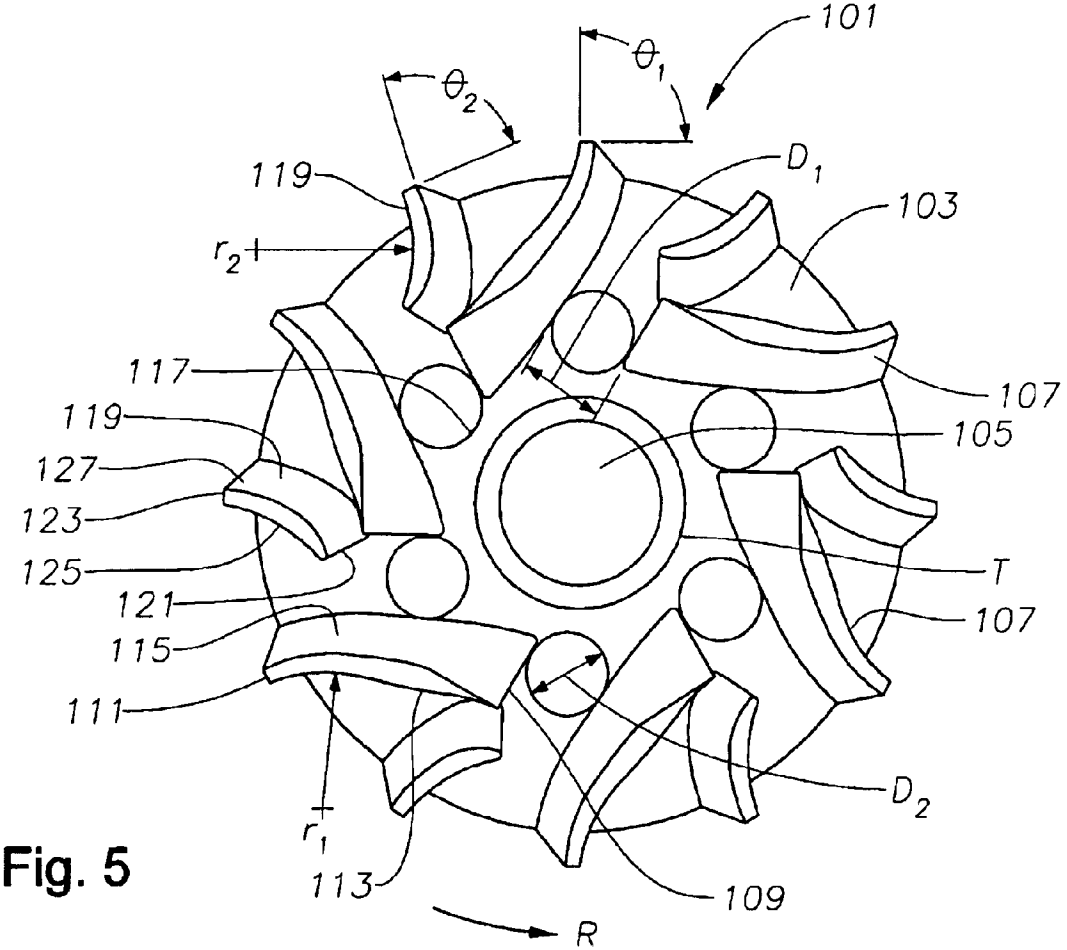
FIG. 5 is a sectional view of an alternative embodiment of an impeller for the centrifugal pump of FIG. 1, taken along the line 3—3 of FIG. 1.

Referring to FIG. 5, an alternative impeller 101 is shown with a direction of rotation R. Impeller 101 preferably includes a shroud or upper surface 103 and an eye 105 located toward the radial center of impeller 101. Well fluids enter impeller 101 through eye 105 and exit impeller 101 at the outer circumference of impeller 101. In the embodiment shown in FIG. 5, a plurality of vanes 107 are formed on shroud 103. First vanes, or vane members 107 extend radially inward from the outer circumference of impeller 101 toward eye 105 at the radial center of impeller 101.

Rotational direction R defines a leading end 109 and a trailing end 111 on each of vanes 107. Rotational direction R also defines a leading surface 113 and a trailing surface 115 on each of vanes 107, so that fluid traveling through impeller 101 from eye 105 engages leading end 109 and leading surface 113 as impeller 101 rotates in rotational direction R. Leading surface 113 exerts forces on fluid passing through impeller 101 in order to increase the velocity of the fluid and thereby pump the fluid through the associated stage of pump 12. Pressure within centrifugal pump 12 is increased with impeller 101 on the side of impeller vanes.

In the embodiment of impeller 101 shown in FIG. 5, each vane 107 preferably defines radius of curvature $r_1$ along an arcuate portion of first vane 107. In the embodiment shown in FIG. 5, radius of curvature $r_1$ extends along the entire length of leading surface 113 so that leading surface 113 is substantially concave in shape while trailing surface 115 is substantially convex in shape. A distance D1 between adjacent first vanes 107 is defined as the shortest distance from trailing surface 115 to leading end 109. A plurality of balance holes 117 are formed through shroud 103 from an upper surface of impeller 101 to a lower surface of impeller 101. In the embodiments of impeller 101 shown in FIGS. 5 and 6, distance D1 is substantially equal to a diameter D2 of each balance hole 117. Balance hole diameter D2 however can vary in range between 45 and 100 percent of D1 like balance holes 58 in FIG. 3.

A second set of vanes, or vane members 119 are formed on shroud 103 between each adjacent pair of first vanes 107. Each vane 119 extends from the outer circumference of impeller 101 radially inward toward eye 105. Direction of rotation R defines a leading end 121 and a trailing end 123 of each vane 119. Direction of rotation R also defines a leading surface 125 and trailing surface 127 of each vane 119. In the embodiment shown in FIGS. 5 and 6, each second vane 119 is preferably about one-half of the length of corresponding first vanes 107. In both of the embodiments shown in FIGS. 5 and 6, trailing ends 123 of second vanes 119 are preferably located equidistant between trailing ends 111 of each pair of adjacent first set of vanes 107.

Each vane 119 preferably includes a radius of curvature $r_2$ defining by an arcuate-shaped portion of second vane 119. Radius of curvature $r_2$ extends along leading surface 125 so that leading surface 125 is substantially concave in shape while trailing surface 127 is substantially convex in shape.

Figure 6:
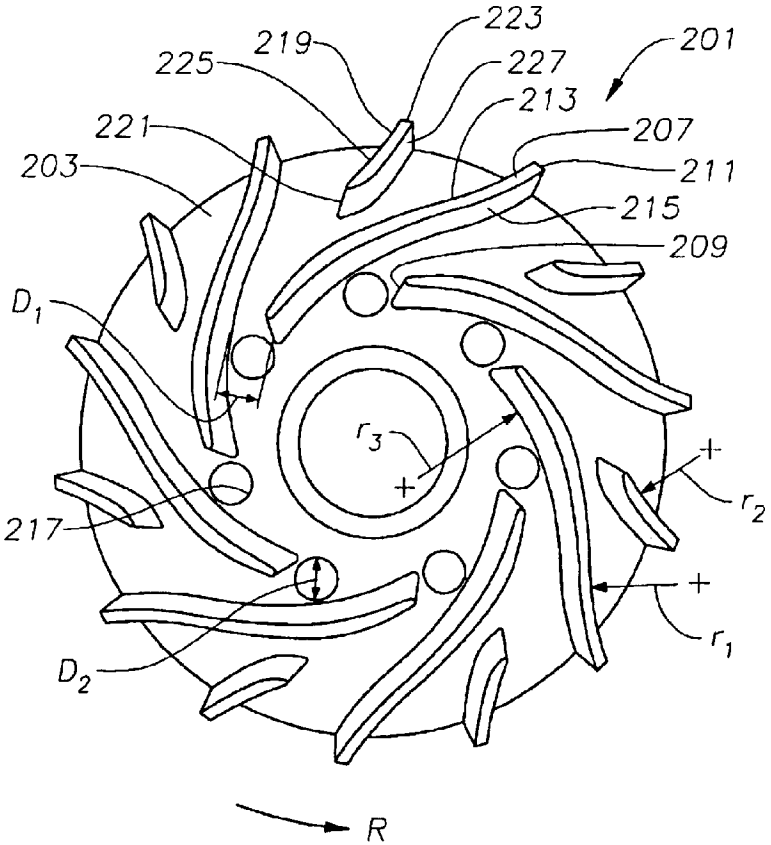
FIG. 6 is a sectional view of another alternative embodiment of an impeller for the centrifugal pump of FIG. 1, taken along the line 3—3 of FIG. 1.

Referring to FIG. 6, radius of curvature $r_1$ is formed along leading surface 213 only on an outer radial portion of first vane 207. In the embodiment shown in FIG. 6, an inner radial portion of first vane 207 curves in another direction from the outer portion, thereby defining another radius of curvature $r_3$. The combination radii of curvatures $r_1$, $r_3$ causes leading surface 213 to have a concave outer radial portion and convex inner radial portion, while causing trailing surface 215 to have a convex outer portion and a concave inner portion. Second vanes 219 in the embodiment shown in FIG. 6 however, remain substantially the same as second vanes 119 in FIG. 5. As shown in FIG. 6, second vanes 219 continue having radius of curvature $r_2$ formed along leading surface 225 so that leading surface 225 remains concave in shape while trailing surface 227 is convex in shape. In both of the embodiments shown in FIGS. 5 and 6, radii of curvature $r_1$, $r_2$ are preferably substantially equal, so that second vanes 119, 219 are substantially identical in shape to the radially outer portion of first vanes 107, 207 in both embodiments.

Referring to FIGS. 5 and 6, trailing ends 111, 211 of each vane in first set of vanes 107, 207 extend toward the outer circumference of impellers 101, 201 at an exit angle $\theta_1$, and trailing ends 123, 223 of each vane in second set of vanes 119, 219 extend toward the outer circumference of impellers 101, 201 at an exit angle $\theta_2$. In the embodiments shown in FIGS. 5 and 6, exit angles $\theta_1$, $\theta_2$ are preferably equal to each other. In the embodiment shown in FIG. 5, exit angles $\theta_1$, $\theta_2$ are substantially 90 degrees with a tangent of the outer circumference of impellers 101, 201. In the embodiment shown in FIG. 6, exit angles $\theta_1$, $\theta_2$ are less than 90 degrees with the tangent of the outer circumference of impeller 101, 201, but greater than 50 degrees.

In operation fluid that is saturated with unseparated gases enters impeller 101 through eye 105 and is transmitted through passageways formed between trailing surface 113, 213 of one vane 107 and a leading end 109 of an adjacent trailing vane 107. As impeller 101 rotates in rotation direction R, the heavier fluids within the mixture of fluid and gases build velocity along leading surface 113 of each of vanes 107. The gases in the saturated fluid do not accelerate as quickly as the heavier fluids within the fluid and gas mixture. Therefore, the gases travel along leading surface 113 slower than the heavier fluid and start being pushed away from leading surface 113 by the heavier fluids being worked on by impeller 101. As the gas particles in the fluid and gas mixture travel radially outward, the distance between the gases and leading surface 113 increases as the heavier fluids increase in velocity along leading surface 113.

The gases and some fluid within the fluid and gas mixture then engage second set of vanes 119. Second vanes 119 increase the velocity of the remaining fluids and the gases mixed in the fluids as impeller 101 rotates. Impeller 101 advantageously increases the efficiency of centrifugal pump 12 with first set of vanes 107 because first set of vanes 107 are continuous from leading end 109 to trailing end 111. Impeller 101 also advantageously continues to avoid gas lock within centrifugal pump 12 with second set of vanes 119 by creating turbulence within the fluid stream and providing a second impeller vane surface to impart work on the remnant gases in the well fluid. Balance holes 117 are also larger than balance holes in the prior art to more readily increase turbulence of the fluid flow within impellers 101 shown in FIGS. 5 and 6 in a manner described above for balance holes 58 shown in FIG. 3. The fluid and remnant gases exiting impeller 101 will exit into diffuser 64 as described previously. In operation, impeller 201 shown in FIG. 6 operates substantially the same as impeller 101 in FIG. 5.

Figure 7:
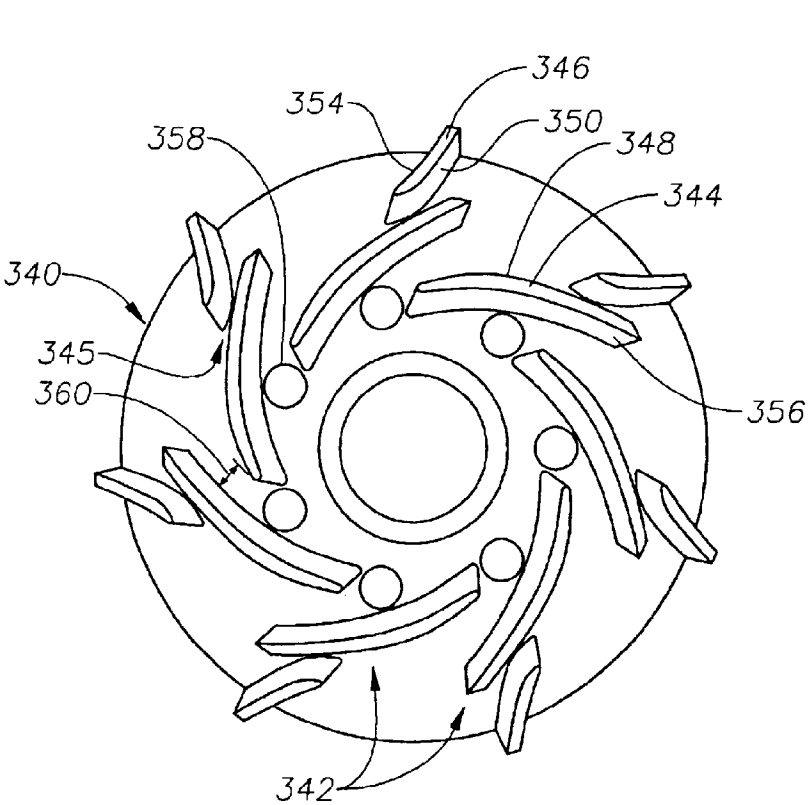
FIG. 7 is a sectional view of another alternative embodiment of an impeller for the centrifugal pump of FIG. 1, taken along the line 3—3 of FIG. 1.

Referring to FIG. 7, impeller 340, which is an alternative embodiment of impeller 40 (FIG. 3), has split vanes 342 with a radius of curvature of inner radial member 344 being located along trailing side 356 instead of leading side 348 so that trailing 356 side is concave and leading side 348 is convex in shape. Outer radial member 346, like second vanes 119 (FIG. 6) continue to have a radius of curvature formed along leading side 354. Trailing side 350 therefore, continues to have a convex shape and leading side 354 continues having a concave shape. Exit angle 351 in FIG. 7 also continues to remain between 50 and 90 degrees because outer radial member 346 is substantially unchanged between the embodiments shown in FIGS. 3 and 7.

Figure 8:
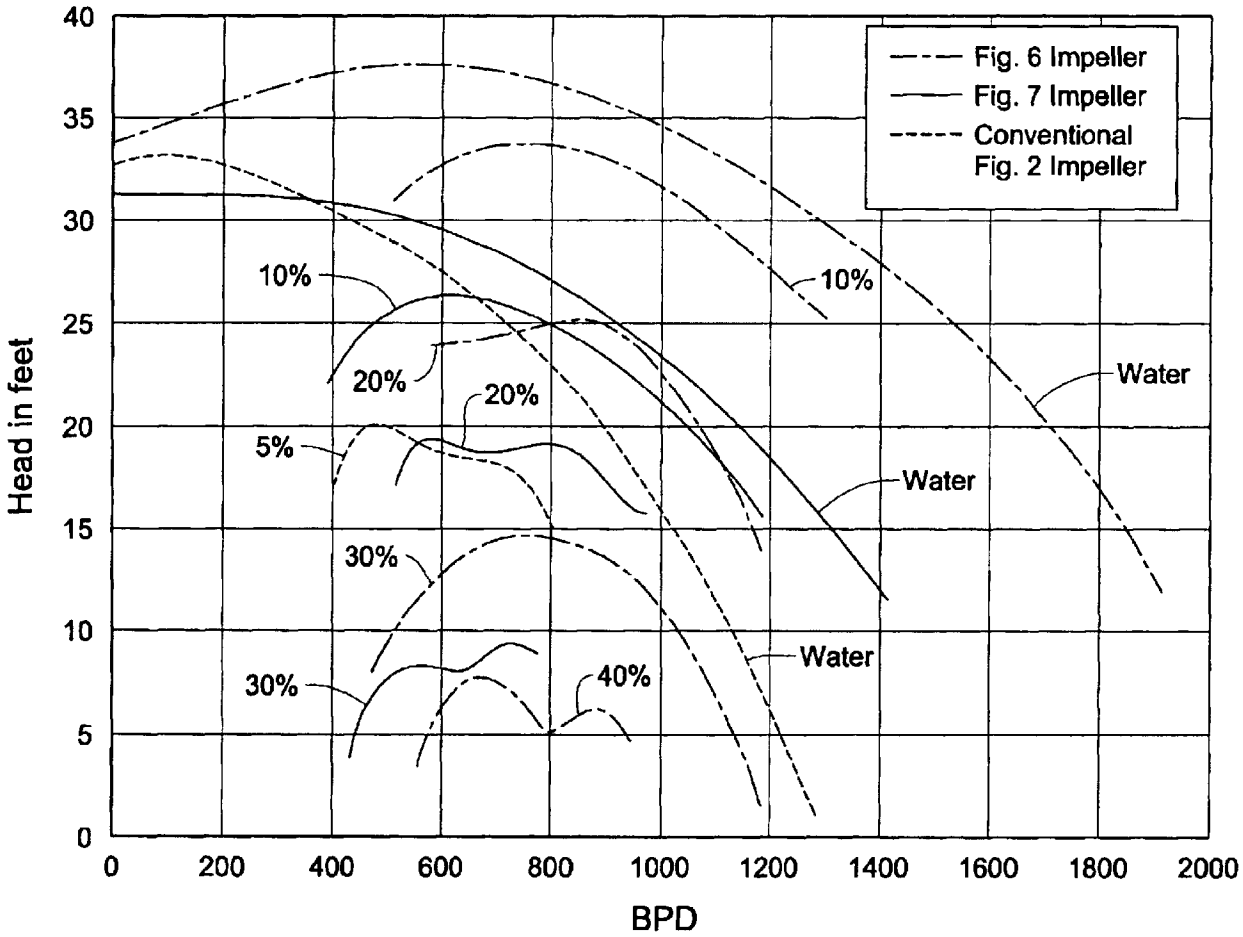
FIG. 8 is a graph comparing performances of a prior art impeller to impellers constructed in accordance with the invention.

Testing of a single pump stage has been performed with a single vane designed in accordance with a prior art conventional impeller substantially similar to conventional impeller 24 shown in FIG. 2, impeller 340 shown in FIG. 7, and impeller 201 shown in FIG. 6. FIG. 8 shows the results of the testing with the head of the fluid being pumped being measured in feet along the vertical axis, and the volumetric flow of the fluid (water in the test cases) being measured along the horizontal axis. Each impeller was tested with a fluid comprising water. The impellers were also tested with different levels of gas remnants mixed into the water. As is apparent from FIG. 8, both impellers 340, and 201 were able to generate more head along most of the volumetric flow range of the test. Additionally, impellers 340 and 201 were both capable of performing with the percent of gas in the water being pumped increased. Impeller 201 was also capable of handling more of an increase than impeller 340 under the same testing conditions.

While the invention has been shown or described in only some of its forms, it should be apparent to those skilled in the art that it is not so limited, but is susceptible to various changes without departing from the scope of the invention.

For example, the impeller design of the present invention can be used in other types of applications besides in wells. Another example is that the impeller can be used for other types of pumping systems aside from electrical submersible pumps. Other applications can include use of the impellers within surface pumps and turbines. Various equipment configurations can also be used, such as placing the gas separator upstream or downstream of the charge pump of the present invention.

That claimed is:

1. A centrifugal pump, comprising:

at least one impeller having an eye at its radial center;

at least one diffuser located to receive fluid exiting each impeller;

a first set of vanes on the impeller, each vane of the first set extending from a selected outer radius of the impeller a first length toward the eye;

a second set of vanes on the impeller, each vane of the second set extending from an outer circumference of the impeller a second length toward the eye, the second length being shorter than the first length; and a balance hole located between each of the first set of vanes that extends through an upper side of the impeller.

2. The centrifugal pump of claim 1, wherein at least one of the vanes of the second set is positioned between each of the vanes of the first set.

3. The centrifugal pump of claim 1, wherein at least one of the vanes of the second set is equally positioned between each of the vanes of the first set.

4. The centrifugal pump of claim 1, wherein the selected outer radius is spaced radially inward from the outer circumference of the impeller.

5. The centrifugal pump of claim 1, wherein the vanes of the first and second sets are curved so that each vane has an exit angle between 50 and 90 degrees with a tangent to an outer circumference of the impeller.

6. The centrifugal pump of claim 1, wherein the vanes of the second set of vanes are curved with a concave side and a convex side, and the impeller rotates so that a leading side of the vanes of the second set of vanes is on the concave side of the vanes.

7. The centrifugal pump of claim 1, wherein the vanes of the second set have a radius of curvature that is substantially the same as a radius of curvature along a radially outward portion of the vanes of the first set of vanes.

8. The centrifugal pump of claim 1, wherein the balance holes are at least as radially inward as a leading edge of each of the vanes of the first and second sets of vanes.

9. A centrifugal pump, comprising:

at least one impeller;

an eye at the radial center of the impeller for receiving a fluid to be pumped;

at least one diffuser located to receive fluid exiting each impeller;

a first set of vanes on the impeller, each vane of the first set extending from an outer circumference of the impeller a first length toward the eye;

a second set of vanes on the impellers, each vane of the second set extending from the outer circumference a second length toward the eye, the second length being shorter than the first length; and a balance hole located between each of the first set of vanes that extends through an upper side of the impeller, and at a radial position that is closer to the eye of the impeller than the outer circumference of the impeller.

10. The centrifugal pump of claim 9, wherein at least one of the vanes of the second set is positioned between each of the vanes of the first set.

11. The centrifugal pump of claim 9, wherein at least one of the vanes of the second set is equally positioned between each of the vanes of the first set.

12. The centrifugal pump of claim 9, wherein the vanes of the first and second sets are curved so that each vane has an exit angle between 50 and 90 degrees with a tangent to an outer circumference of the impeller.

13. The centrifugal pump of claim 9, wherein the vanes of the first and second sets of vanes are curved with a concave side and a convex side, and the impeller rotates so that a leading side of the vanes is on the concave side of the vanes.

14. The centrifugal pump of claim 9, wherein the vanes of the second set have a radius of curvature that is substantially the same as a radius of curvature along a radially outward portion of the vanes of the first set of vanes.

15. The centrifugal pump of claim 9, wherein the vanes of the first set of vanes are curved so that a leading side of each first set vane has an outer radial portion that is concave in shape and an inner radial portion that is convex in shape, and the vanes of the second set are curved so that a leading side is concave in shape.

16. The centrifugal pump of claim 9, wherein the balance hole has a diameter that is between about 45 percent to about 100 percent of a length extending from a trailing surface of one of the vanes in the first set of vanes to a leading edge of an adjacent and trailing vane of the first set of vanes.

17. A centrifugal pump, comprising:

at least one impeller having an eye at its radial center;

at least one diffuser located to receive fluid exiting each impeller;

a first set of vanes on the impeller, each vane of the first set extending from an outer radius of the impeller a first length toward the eye;

a second set of vanes on the impellers, each vane of the second set extending from an outer circumference of the impeller a second length toward the eye, the second length being shorter than the first length and the outer radius having a radial position so that the outer ends of the first set of vanes is radially inward from the outer ends of the second set of vanes; and a balance hole located between each of the first set of vanes that extends through an upper side of the impeller, and at a radial position that is closer to the eye of the impeller than the outer circumference of the impeller.

18. The centrifugal pump of claim 17, wherein the first and second sets of vanes are curved, and an outer end of the second set of vanes is curved in the same direction as an outer portion of the first set of vanes.

19. The centrifugal pump of claim 17, wherein the first and second sets of vanes are curved, and an outer end of the second set of vanes is curved in the opposite direction from an outer portion of the first set of vanes.

20. The centrifugal pump of claim 17, wherein an outer end of the first set of vanes is farther radially outward from an inner end of the second set of vanes.

21. The centrifugal pump of claim 17, wherein at least one of the vanes of the second set is positioned between each of the vanes of the first set.

* * * * *